US005444924A

United States Patent [19]

Joslin et al.

[11] Patent Number: 5,444,924

[45] Date of Patent: Aug. 29, 1995

[54] ELECTRONIC CONTROL OF CLOTHES DRYER

[76] Inventors: Dan F. Joslin; Dan J. Ryherd, both c/o WCI Laundry Division, 600 Stockdale St., Webster City, Iowa 50595

[73] Assignee: White Consolidated Industries, Inc., Cleveland, Ohio

[21] Appl. No.: 139,005

[22] Filed: Oct. 21, 1993

Related U.S. Application Data

[62] Division of Ser. No. 514,700, Apr. 26, 1990, Pat. No. 5,291,667.

[51] Int. Cl.[6] ..... F26B 3/00

[52] U.S. Cl. ..... 34/486; 34/562

[58] Field of Search ..... 34/44, 45, 48, 486, 34/562

[56] References Cited

U.S. PATENT DOCUMENTS

| | | | |
|---|---|---|---|
| 3,363,326 | 1/1968 | Weeks | 34/45 |
| 3,583,688 | 6/1971 | Fuqua et al. | 34/45 |
| 4,206,552 | 6/1980 | Pomerantz et al. | 34/44 |
| 4,231,166 | 11/1980 | McMillan | 34/48 |
| 4,286,391 | 9/1981 | Gerry | 34/44 |
| 4,372,054 | 2/1983 | Pometantz et al. | 34/44 |
| 4,397,101 | 8/1983 | Rickard | 34/48 |
| 4,485,566 | 12/1984 | Vivares | 34/44 |
| 4,531,305 | 7/1985 | Nagayasu et al. | 34/486 |
| 4,622,759 | 11/1986 | Abe et al. | 34/44 |
| 4,713,894 | 12/1987 | Roth et al. | 34/48 |
| 4,788,775 | 12/1988 | Ahmed | 34/48 |
| 4,827,627 | 5/1989 | Cardoso | 34/44 |
| 5,050,313 | 9/1991 | Wakaeya et al. | 34/46 |

FOREIGN PATENT DOCUMENTS

| | | |
|---|---|---|
| 6170199 | 9/1984 | Japan . |
| 63147500 | 12/1986 | Japan . |
| 2220698 | 2/1989 | Japan . |

*Primary Examiner*—Denise L. Gromada

[57] ABSTRACT

A control system for a clothes dryer is disclosed. A microprocessor monitors the heated inlet air temperature and the exhaust temperature. If the inlet temperature exceeds a high limit value a given number of times, an air blockage indicator is activated. Degrees of dryness are measured by the number of times the inlet temperature has dropped below a threshold value while the heater is off because the exhaust temperature has exceeded a desired value. An estimated drying time is calculated and displayed to the user based on a linear function of the inlet and exhaust temperatures measured at the beginning of the cycle and again a short time later.

4 Claims, 5 Drawing Sheets

ELECTRONIC CONTROL OF CLOTHES DRYER

This applicational is a divisional of Ser. No. 07/514,700, now U.S. Pat. No. 5,291,667.

BACKGROUND OF THE INVENTION

The present invention relates to a control system and method for the operation of a clothes dryer.

It is well known to provide clothes dryers with a lint filter to remove lint picked up from the articles or load being dried. If the filter becomes clogged by excessive lint, the airflow through the dryer is restricted and the necessary time to dry the load is increased.

The status of the lint filter may be monitored by means of airflow and pressure sensors that provide indication of blockage during the time air is flowing through the dryer. Typically, serious blockages of airflow result in excessive temperatures in the area of the air heater, resulting in the intermittent opening of a high limit thermostat that deactivates the heater. The sensors or thermostats can be connected to an indicator to apprise the operator of the condition. However, these methods provide an indication of air blockage only during airflow through the dryer.

It is desirable to know the degree of dryness of the load. This is useful for operator removal of the load at a given dryness or for helping the operator predict the time remaining to dry.

The dryness of the load may be monitored by such means as sensing the rapid rise in exhaust temperature when the load is nearly dry and by actual humidity sensors. Unfortunately, the monitoring of exhaust temperature does not provide entirely satisfactory results and humidity sensors represent a substantial increase in sensor costs.

SUMMARY OF THE INVENTION

The present invention provides a simple, integrated means for alerting the operator that an air blockage has occurred and for indicating the degree of dryness exhibited by the load. In addition, the operator is provided with an estimated drying time, allowing convenient scheduling and planning.

The dryer control system for a dryer including a heater, an air inlet receiving air from the heater, and an air exhaust exhausting the air from the dryer comprises: a control means; an inlet temperature measuring means connected to the control means; an exhaust temperature measuring means connected to the control means; an estimated drying time display means connected to the control means; a dryness display means connected to the control means; and a blockage indicator means connected to the control means. The control means samples the inlet temperature at a first and second time, samples the exhaust temperature at a first and second time, forms a first difference between the second and first inlet temperatures, forms a second difference between the second and first exhaust temperatures, calculates the estimated drying time as a function of the first and second differences, and displays the estimated drying time on the estimated drying time display. Also, the control means monitors the inlet temperature, increments a number each time the inlet temperature exceeds a predetermined value, and activates the blockage indicator means when the number exceeds a predetermined threshold. In addition, the control means monitors the exhaust temperature, deactivates the heater when the exhaust temperature exceeds a predetermined maximum exhaust temperature, activates the dryness display means when the inlet temperature drops below a predetermined inlet temperature, and activates the heater when the exhaust temperature drops below a predetermined minimum exhaust temperature.

DESCRIPTION OF THE PREFERRED EMBODIMENTS

Figure 1:
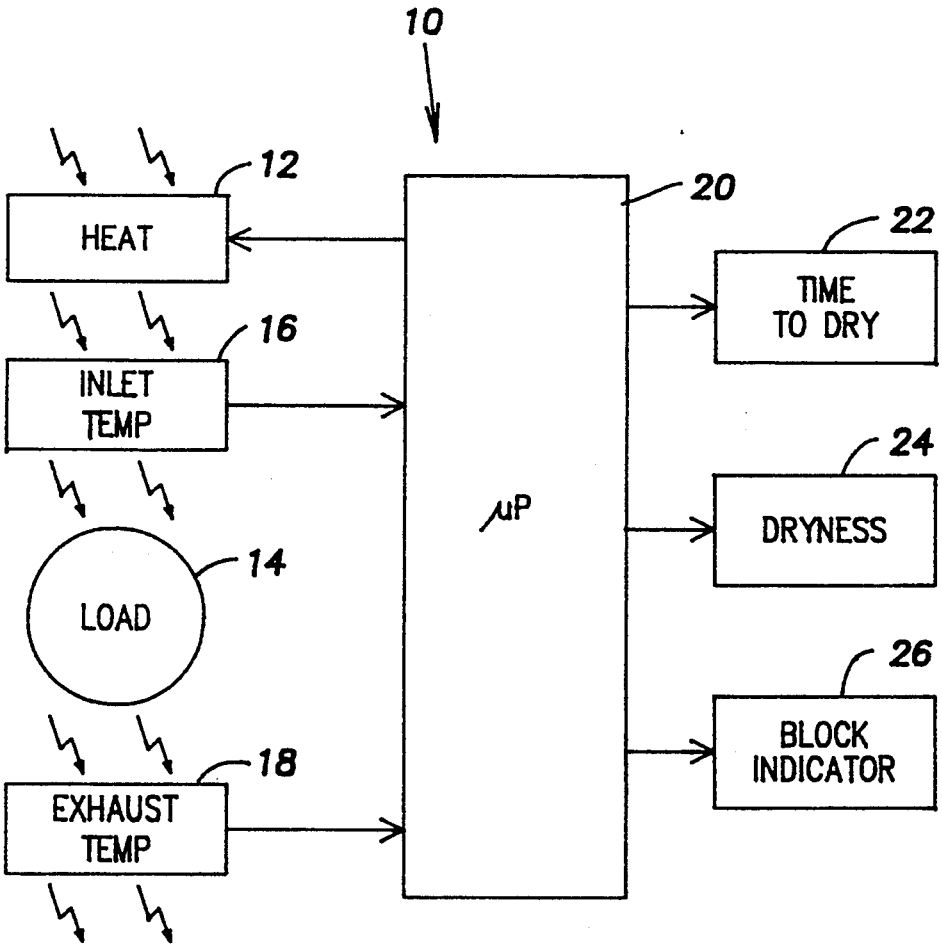
FIG. 1 is a schematic diagram of a clothes dryer according to the invention.

A clothes dryer 10 according to the invention is shown in FIG. 1. A heater 12 provides heated air to a load 14 of clothes or other articles. The heater 12 may be, for example, of the resistive electric type or the combustion type.

After moving about the load 14, the air is exhausted from the dryer 10. The temperature 16 of the inlet air and the temperature 18 of the exhaust air is measured, for example, by thermistors or resistors with known temperature/resistance characteristics.

The temperatures 16, 18 are provided to a controller 20. In the preferred embodiment, the controller 20 comprises a microprocessor which is programmed to perform the functions described below. The controller 20 also includes the necessary support circuitry to activate and deactivate the heater 12 and to monitor the temperatures 16, 18.

In addition, the controller 20 controls the display of information on a time to dry display 22, a dryness display 24, and an air blockage indicator 26.

The time to dry display 22 may be, for example, a numeric display of the vacuum fluorescent type. The air blockage indicator 26 may be, for example, a simple signal light or it may be an indicia such as "CLEAN FILTER" on a vacuum fluorescent display. The dryness display 24 may be, for example, a vacuum fluorescent display capable of displaying a series of numerical or word indicia indicating dryness, or a series of lights capable of being sequentially activated, each member of the series indicating a level of dryness. Alternatively, the dryness display 24 may be, for example, a single light that simply indicates that the load 14 is dry.

Figure 2:
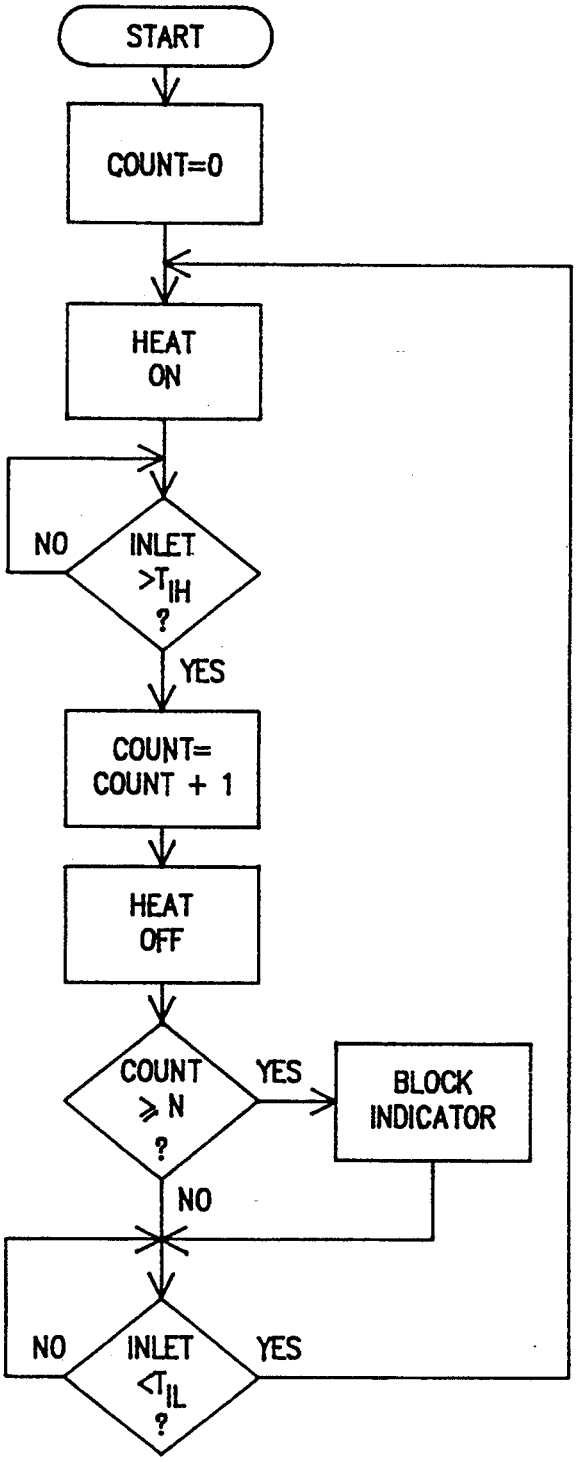
FIG. 2 is a flow chart diagram of a method according to the invention for detecting an air blockage in the dryer.

FIG. 2 shows a flow chart of a method for detecting an air blockage according to the invention. Initially, all variables are initialized and the heater 12 is activated. The controller 20 compares the measured inlet temperature 16 to an inlet high limit temperature $T_{IH}$. This temperature may be, for example, 150° C.

If the inlet temperature 16 is greater than $T_{IH}$, the variable COUNT is incremented. In the preferred embodiment, the heater 12 is also deactivated at $T_{IH}$ to prevent excessive temperatures about the heater 12. If desired, the heater 12 could be deactivated at some higher temperature and still provide the desired protection.

If COUNT is equal or greater than a threshold N (e.g. 2), the blockage indicator 26 is activated and remains so whether air is flowing through the dryer 10 or the heater 12 is on or off.

In this way, the operator has a much better opportunity to notice the blockage indicator 26.

When the inlet temperature 16 drops below an inlet low limit temperature $T_{IL}$ (e.g. 100° C.) the heater 12 is reactivated and the process continues.

Figure 3:
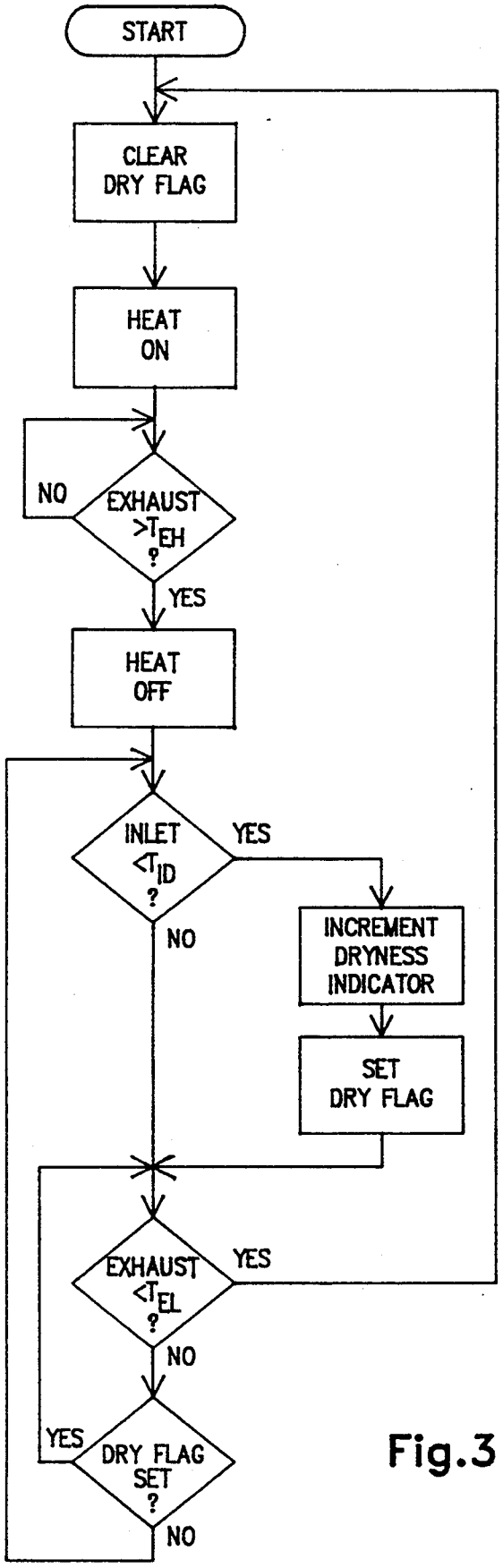
FIG. 3 is a flow chart diagram of a method according to the invention for measuring the dryness of a load in a dryer.

FIG. 3 shows a flow chart of a method according to the invention for measuring the dryness of the load 14 in the dryer 10. Initially, all variables are initialized and the heater 12 is activated. The controller 20 compares the measured exhaust temperature 18 to an exhaust high limit temperature $T_{EH}$. This temperature may be, for example, 55° C. for cotton or 40° C. for knits.

If the exhaust temperature 18 exceeds $T_{EH}$, the heater 12 is deactivated. The controller 20 then compares the measured inlet temperature 16 to a threshold dryness temperature $T_{ID}$. This temperature may be, for example, 55° C.

If the inlet temperature 16 drops below $T_{ID}$, the dryness display 24 is incremented (e.g. either a numerical value is incremented, or a light in a sequence is illuminated) and the DRY FLAG is set. If a simpler display is desired, the dryness display 24 may simply provide the same indication after the first time it is activated until the variables are again initialized.

Whether the inlet temperature 16 drops below $T_{ID}$, or not, the exhaust temperature 18 is monitored by the controller 20. If the exhaust temperature 18 drops below an exhaust temperature lower limit $T_{EL}$ (e.g. 30° C. for cotton or 25° C. for knits), the cycle starts over. Otherwise, if the DRY FLAG is set, the controller 20 continues to monitor the exhaust temperature 18 with respect to $T_{EL}$. If the DRY FLAG is not set, the controller 20 goes back to monitoring the inlet temperature 16.

If the incrementing display is used, the dryness display 24 indicates successively dryer states of the load 14 as operation of the dryer 10 continues. This allows the operator to remove the load 14 at a given dryness, or estimate the remaining time required.

There is a correlation between the inlet and exhaust temperatures 16, 18 near the beginning of a drying cycle to the time required to dry the load 14. It has been found that a linear equation using the inlet and exhaust temperatures 16, 18 provides a good estimate of the drying time required for the load 14.

The inlet temperature 16 is measured at the start of the drying cycle to give a value $T_{IO}$ and at a time $t_m$ to give a value $T_{Im}$. The time $t_m$ may be, for example, 3 minutes into the drying cycle.

Similarly, the exhaust temperature 18 is measured at the start of the drying cycle to give a value $T_{EO}$ and at the time $t_m$ to give a value $T_{Em}$. It would of course be possible to use a time near the beginning of the cycle other than $t_m$.

It has been found that the following equation provides a good estimate of the required drying time D:

$$D=K+W_I(T_{Im}-T_{Io})+W_E(T_{Em}-T_{EO})$$

where K, $W_I$, and $W_E$ are constants that depend on the type of load 14 being dried.

Figure 4:
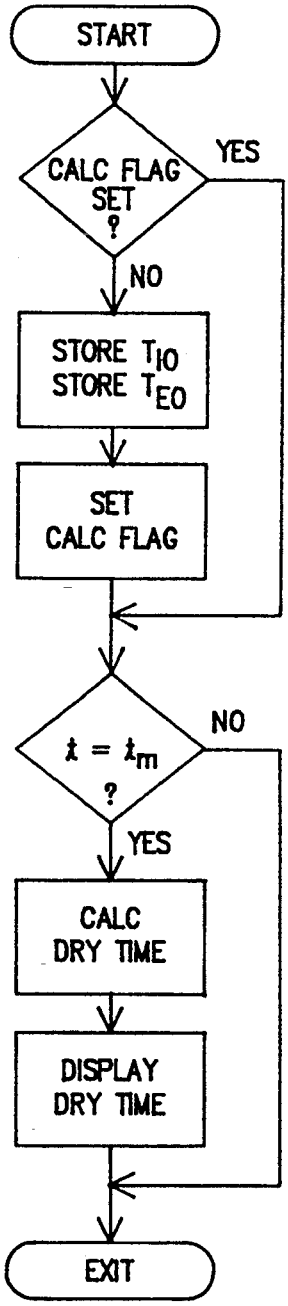
FIG. 4 is a flow chart diagram of a method according to the invention for estimating the drying time for a load in a dryer.

For example, if D is measured in seconds, the temperatures measured in Celsius degrees and $t_m=3$ minutes, the following values may be used:

COTTON: $K=3809$, $W_I=7.19$, and $W_E=-87.7$
PERMANENT PRESS: $K=2232$, $W_I-11.5615$, $W_E=-108.25$ FIG. 4 shows a flow chart of a method according to the invention for estimating the drying time required for a load 14.

Initially, the inlet temperature 16 is stored to $T_{IO}$ and the outlet temperature 18 is stored to $T_{EO}$. All steps are then bypassed until the time, t, into the drying cycle equals $t_m$. Then the inlet and exhaust temperatures 16, 18 are measured again and the calculation described above performed to find the estimated drying time.

The calculated drying time is then displayed on the time to dry display 22. The time displayed may be the estimate itself, the estimate minus the elapsed time, or, with a time of day clock added, the estimated time of day for completion.

By having the estimated drying time, the operator can have a general idea of when the load 14 will be complete. During a cycle where the clothes may need to be removed right away to avoid wrinkling, if the cycle is completed earlier then the estimated time, the load can be periodically tumbled to balance out the remaining time.

Figure 5:
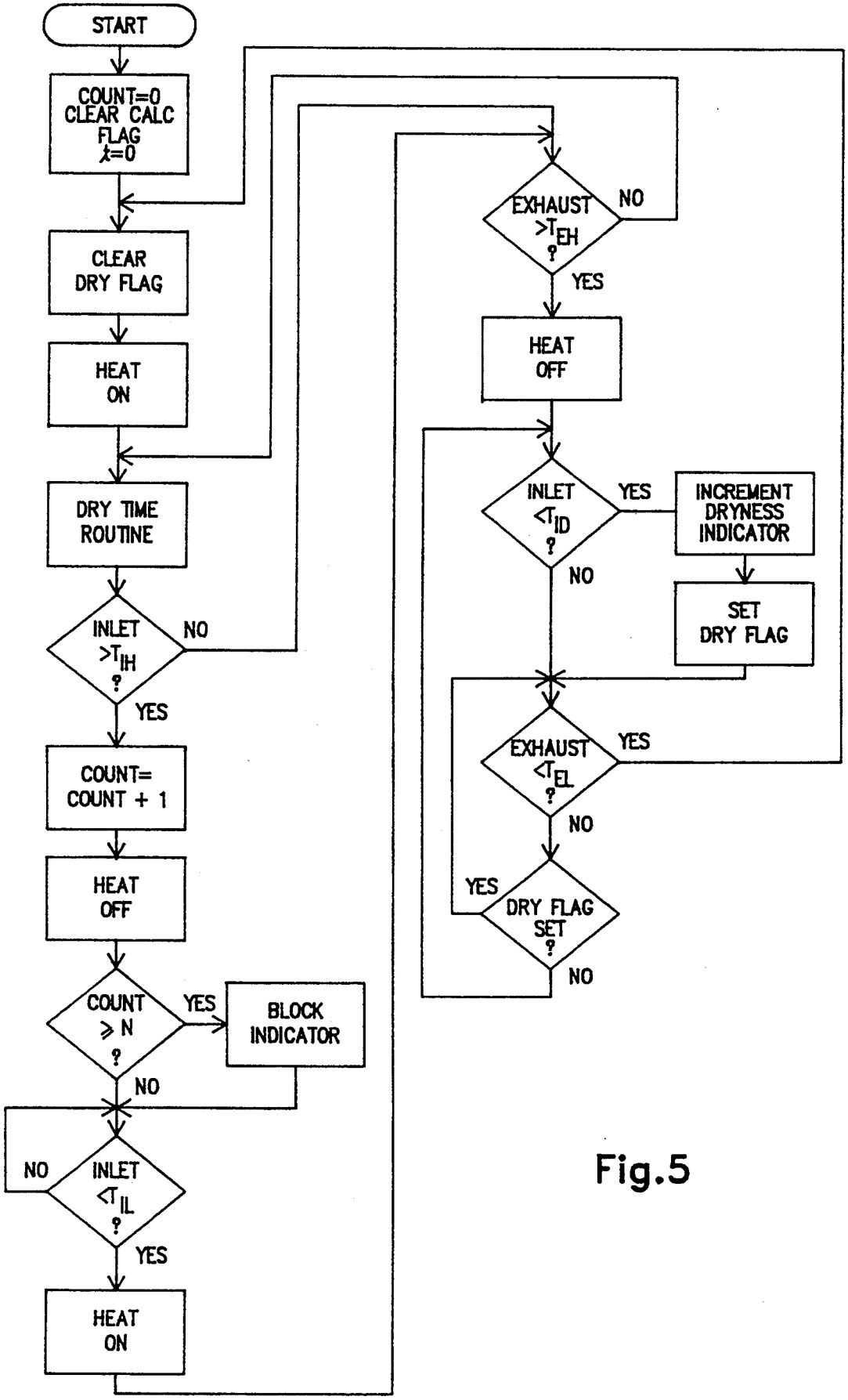
FIG. 5 is a flow chart diagram of a method according to the invention for detecting an air blockage, measuring the dryness of a load in the dryer, and estimating the drying time for the load.

FIG. 5 shows a flow chart combining the above-described methods into a single method according to the invention for providing a coordinated, single control system for the dryer 10. The block labeled DRY TIME ROUTINE performs the method set forth in FIG. 4.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A method for predicting a time required for drying a load in a dryer including a heater, an air inlet receiving air from said heater and having a temperature, and an air exhaust exhausting said air from said dryer and having a temperature, the method comprising:

measuring said inlet temperature at a first and second time;

measuring said exhaust temperature at a first and second time;

forming a first difference between the second and first inlet temperatures;

forming a second difference between the second and first exhaust temperatures; and predicting the required drying time as a function of said first and second differences.

2. A method according to claim 1, wherein said inlet temperature measuring first and second times are substantially the same, respectively, as said exhaust temperature measuring first and second times.

3. A method according to claim 1, wherein said function is a linear function of said first and second differences.

4. A method according to claim 1, further comprising displaying said required drying time on a display means.

* * * * *